US005211245A

United States Patent [19]

Relyea et. al.

[11] Patent Number: 5,211,245

[45] Date of Patent: May 18, 1993

[54] VEHICLE MOUNTED AERIAL LIFT

[75] Inventors: Robert G. Relyea, Dallas, Tex.; Edward V. Garnett, Huntington Bch., Ca.

[73] Assignee: Crash Rescue Equipment Service, Inc., Dallas, Tex.

[21] Appl. No.: 723,577

[22] Filed: Jul. 1, 1991

[51] Int. Cl.[5] ..... A62C 27/00

[52] U.S. Cl. ..... 169/24; 169/25; 212/238

[58] Field of Search ..... 169/24, 25, 52; 414/694, 695.5; 212/261, 238; 239/165, 166; 182/2

[56] References Cited

U.S. PATENT DOCUMENTS

| | | | |
|---|---|---|---|
| 3,005,512 | 10/1961 | Vogan | 182/2 |
| 3,253,677 | 5/1966 | Krynytzky et al. | 169/24 X |
| 3,346,052 | 10/1967 | Moore et al. | 169/25 |
| 3,367,280 | 2/1968 | Bennett et al. | 239/166 X |
| 3,527,362 | 9/1970 | Allen | 212/238 |
| 3,599,722 | 8/1971 | Davidson | 169/24 |
| 3,820,606 | 6/1974 | Terayama | 169/25 |
| 3,840,074 | 10/1974 | Clark | 169/24 |
| 4,222,457 | 9/1980 | Ashworth | 182/2 |
| 4,453,672 | 6/1984 | Garnett . | |

FOREIGN PATENT DOCUMENTS

| | | | |
|---|---|---|---|
| 317891 | 5/1989 | European Pat. Off. | 169/24 |
| 3800037 | 7/1989 | Fed. Rep. of Germany | 169/52 |
| 1045281 | 11/1953 | France | 212/261 |
| 1413973 | 9/1965 | France | 212/238 |
| 2511406 | 2/1983 | France | 414/694 |

*Primary Examiner*—David M. Mitchell
*Assistant Examiner*—Gary C. Noge
*Attorney, Agent, or Firm*—Jones, Day, Reavis & Pogue

[57] ABSTRACT

An aerial lift for use with a vehicle for positioning the nozzle on the outer end of an upper boom coupled at its inner end to the outer end of a lower boom with selectively raising and lowering the lower boom in a plane from and above the horizontal and rotating the lower boom about a vertical axis, and independently articulating the upper boom about its inner end with respect to the lower boom such that the upper boom is selectively movable above and below the horizontal plane.

25 Claims, 3 Drawing Sheets

VEHICLE MOUNTED AERIAL LIFT

FIELD OF THE INVENTION

The present invention relates to vehicle aerial lifts in general and in particular to an aerial lift that has a boom that can be extended in front of the cab while in the resting position and which can be elevated up to a maximum height but which also can be tilted to allow the nozzles on the end of the boom to be lowered to or below ground level. In addition, the nozzle has the capability of rotating 90° either side of the center line of the boom or 225° in the vertical plane, 45° above the plane of the boom and 180° below the plane of the boom.

BACKGROUND OF THE INVENTION

Prior art aerial lifts or hydraulic platforms are of many types. In U.S. Pat. No. 4,453,672, there is disclosed an aerial lift which permits rotation about a vertical axis during use through a full 360° to any position. The lift accommodates extensions and retractions of an extensible boom formed as a part of conventional lower and upper booms. A single hydraulic cylinder raises and lowers a pair of pivotally connected lower and upper booms. The upper and lower booms are connected together such that the movement of the lower boom causes the outward end of the upper boom to move generally vertically upwardly rather than in an arc toward or away from the vehicle. A fluid supply line for a nozzle at the upper end of the lift accommodates relative movement between various parts of the lift as well as rotation of the lift to different angular positions.

One of the problems associated with the aerial lift disclosed in U.S. Pat. No. 4,453,672 is that the upper boom with the fluid nozzle at the end thereof can move only from the horizontal upwardly. It can not be tilted upwards so that the boom can be extended downwardly toward the ground. Further, the nozzle on the end of the boom can be moved in a vertical plane but it can not be directed in a horizontal plane. Thus, it is difficult to use such aerial lift for purposes such as fighting fires because the vehicle itself must be positioned in certain instances to direct the fluid flow and in other instances can not project the fluid from positions near the ground level. Further, the entire boom assembly must be rotated to aim the fluid in various directions.

It would be advantageous to have an aerial lift assembly which has an upper boom that could be tilted toward the ground as well as pivoted upwardly. It would also be advantageous to have a nozzle assembly on the outer end of the upper boom which not only could be pivoted in the vertical plane but could also be rotated in a plane perpendicular to the vertical plane.

Further, where a fire is contained within the structure, it would be advantageous to know where the fire needs control most urgently. If the hot spots were known, the fire could be attacked at those points.

Also, in remotely controlled aerial lifts, the fluid flow quantity is fixed and can be adjusted only by changing the pressure.

In addition, where the operator is sitting in a vehicle, it is sometimes difficult to have a complete view of the object containing the fire because of other objects blocking the view.

Finally, if the structure or object containing the fire is surrounded with a great deal of smoke, it is difficult to know how close the nozzle assembly of the aerial lift is to the structure containing the fire because of the smoke.

The present invention adds a piercing nozzle to the boom which has a hardened steel point and a sprayer unit that enables the piercing nozzle to be forced through the wall of the structure containing the fire so that the flame-retardant fluids may be injected directly into the interior of the structure. In addition, a heat sensor is mounted on the end of the boom assembly, so that it can be used to scan the object containing the fire and determine where the hot spots are located. The piercing nozzle can then be directed towards the hot spots and pierce the structure so that the fire retardant fluids can be injected into the interior of the container at the proper locations.

Also, because the structure containing the fire may be surrounded with thick smoke so that the operator cannot see the container, an acoustic proximity system is placed on the end of the boom to detect the position of the end of the boom relative to the structure as it is approaching the structure, even though the structure cannot be seen.

Further, a video camera is mounted on the outer end of the boom so that the operator can raise the boom and the aerial lift high above the structure containing the fire and can scan the area about the structure so that the picture can be transmitted back to the operator in the cab of the vehicle thereby ensuring that all information necessary to the containment of the fire can be available to the operator.

Finally, the present invention overcomes the disadvantages of the prior art by having a remote electronic control of the fluid flow quantity by restricting an orifice and simultaneously controlling the flow pattern by varying the orifice fluid flow direction. This control is accomplished by switches in the cab that can be mounted as needed.

The present invention also allows the upper boom to be tipped upwardly approximately 45° above horizontal and to be tilted downwardly to a point just above the cab of the vehicle. In this position, extension of the upper boom will position the nozzle device in various positions below the horizontal plane to address a variety of tasks. By extending the boom, the nozzle can be lowered to ground level or below ground level if necessary to reach over embankments, bridges or piers. The nozzle itself has the capability of rotating 90° either side of the center line of the boom. This allows the nozzle to be rotated 180° in the horizontal plane. In addition, the nozzle can be rotated plus 45° above the center line of the boom and minus 180° below the center line of the boom for a total rotation in the vertical plane of 225°. This unique feature makes positioning of the vehicle less critical in respect to a fire.

Thus, it is an important aspect of the present invention to provide a movable boom which can be elevated not only above the horizontal but can also be tipped downwardly below the horizontal and extended to the point that a nozzle on the outer end thereof can be lowered to or below ground level.

It is also an important aspect to the present invention to have a nozzle that can operate in both the horizontal plane and vertical plane with respect to the center line of the boom thereby enabling the nozzle to be extended into a doorway, for example, of a building or a vehicle and the nozzle rotated in both horizontal and vertical planes to extinguish a fire on the inside of the object.

SUMMARY OF THE INVENTION

Thus, the present invention relates to an improved aerial lift for a vehicle of the type having an upper boom with its inner end pivotally connected to the outer end of a lower boom for pivotal movement with respect to each other, a support attached to the vehicle for rotation about an upright axis, the lower boom being pivotally connected at its inner end to the support and extending generally horizontally in a stored position, means coupled between the support and the lower boom for moving the lower boom upwardly and downwardly above the horizontal about its pivotal connection to the support, the improvement comprising variable length link means having an inner end pivotally connected to the support and an outer end pivotally connected to the inner end of the upper boom such that movement of the lower boom upwardly causes the outer end of the upper boom to arise generally vertically as the lower boom is raised, and means coupled between the inner and outer ends of the variable length link means for selectively changing the length of the link to move the upper boom about its pivot point with the lower boom in any stationary position of the lower boom.

BRIEF DESCRIPTION OF THE DRAWINGS

These and other objects of the invention will be more readily understood when taken in conjunction with the accompanying specification and drawings in which drawings having like numerals represent like components and in which.

DETAILED DESCRIPTION OF THE DRAWINGS

Figure 1:
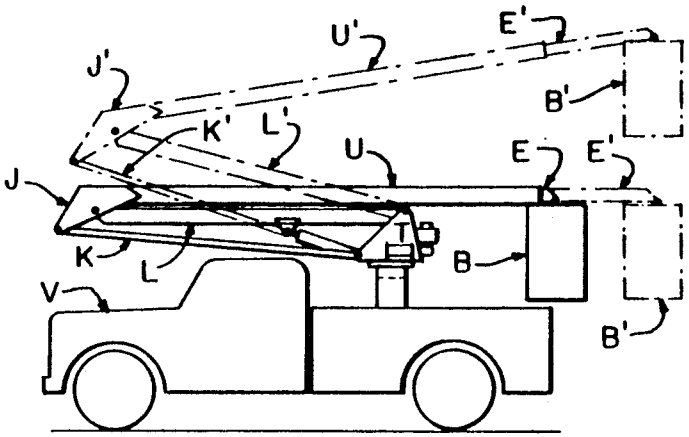
FIG. 1 PRIOR ART
FIG. 1 is a side elevation of a prior art aerial lift in storage position on a vehicle and showing certain other positions of parts thereof in phantom lines.

An aerial lift of the prior art is shown in FIG. 1 and may be mounted on a vehicle V as illustrated. The lift may include a turntable T conveniently rotatable 360° and on which a lower boom L and a pair of links K are pivotally mounted at different positions. A hydraulic cylinder C, which may be pivotally mounted to turntable T at the same position as the link K, is also pivotally attached to lower boom L to elevate the same. A knee joint J is mounted on and fixedly receives a portion of the inner end of upper boom U while both the lower boom L and the link K are pivotally connected to the knee joint J. A slightly modified parallelogram is formed by lines connecting the pivot points at the inner and outer ends of the lower boom and link. Thus, the parallelogram is formed by the lines between the outer pivot points of the lower boom and links and the inner pivot points of the lower boom and links, respectively. An extensible boom E is slidable outwardly and inwardly from an upper boom U while a workmens cage or basket B is pivotally supported by the extensible boom. As in FIG. 1, the extensible boom E may be moved outwardly to a position E' with the basket B thereby being moved to a position B'. Also the hydraulic cylinder C may be extended to move the lower boom L upwardly to a position L' which automatically moves the joint J to a position J' and the upper boom U to a position U' with the links K moving to a position K' and determining the angularity between the lower boom and the upper boom. It will be noted that the sides of the modified parallelogram formed by the lines between the above pivot points will remain the same in length, but the angles at the corners of the modified parallelogram will vary when the lower boom is raised to the position as indicated by the phantom lines from the stored position shown in FIG. 1. As can be seen in FIG. 1, as the lower boom L is raised, the upper boom U can never be moved to a position below the horizontal and in fact moves increasingly above the horizontal as the lower boom L is moved upwardly about its pivot point on the turntable T.

Figure 2:
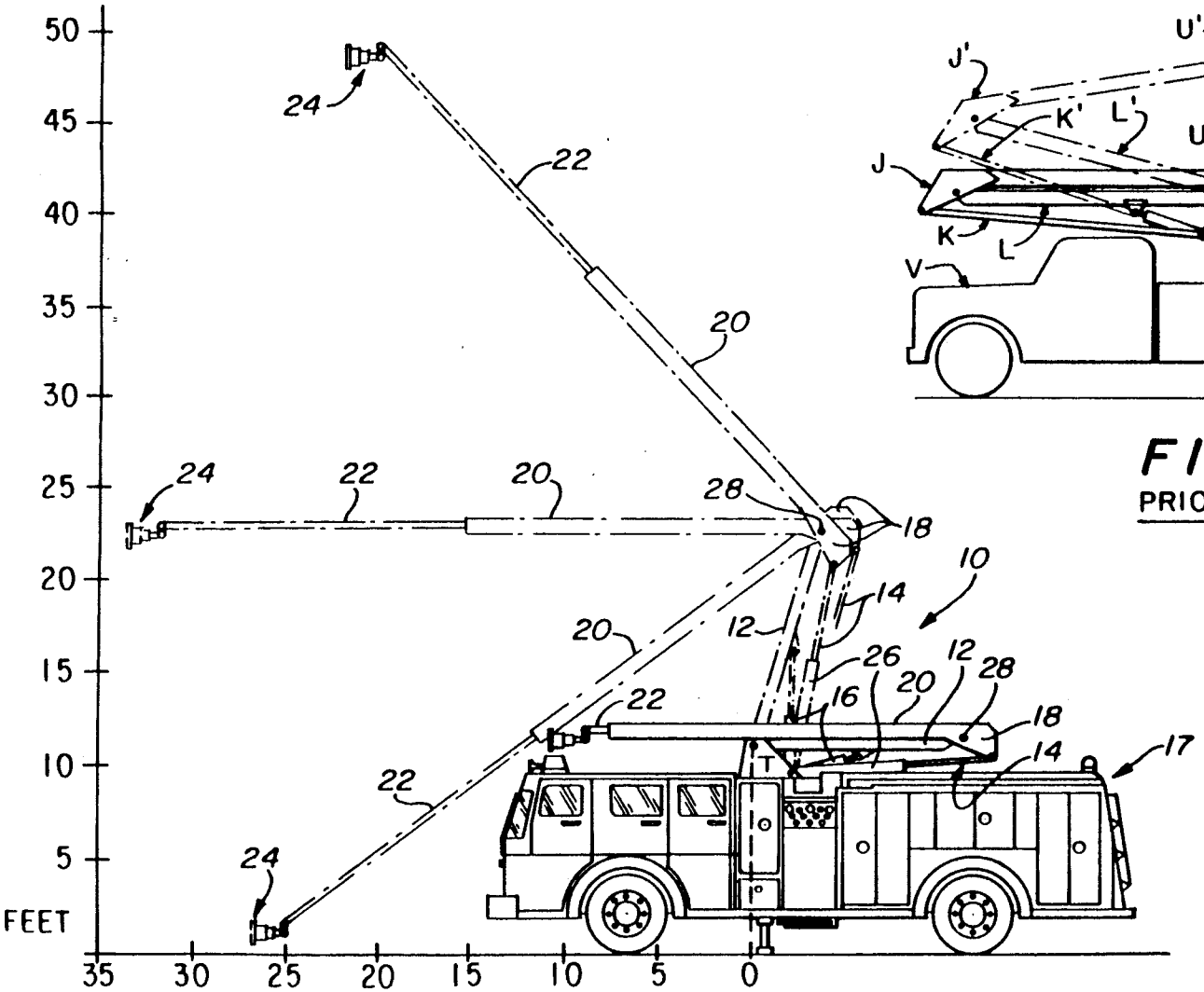
FIG. 2 is a side elevation of the novel aerial lift of the present invention again showing the storage position on a vehicle and illustrating certain other positions of the boom available with the present invention.

The present invention is disclosed in detail in FIG. 2 and illustrates a vehicle 10 that may include a turntable T, conveniently rotatable 360° about a vertical axis, on which a lower boom 12 and a pair of links 14 are pivotally mounted at different positions. A hydraulic cylinder 16, which may have one end pivotally attached to the turntable T at the same position as the links 14, is also pivotally attached at the other end to the lower boom 12 to elevate or lower the same. A knee joint 18 is rigidly mounted on, or may be integrally formed with, a portion of the inner end of an upper boom 20. Both the lower boom 12 and the links 14 are pivotally connected to the knee joint 18 at spaced locations. An extensible boom 22 is slidable outwardly and inwardly within the upper boom 20. A nozzle assembly 24 is pivotally supported by the extensible boom 22. When at rest, the lower boom 12 and the upper boom 20 are nested on top of the vehicle 10 as illustrated in FIG. 2. As piston 16 is actuated to move lower boom 12 upwardly, the upper boom 20 has a tendency to move as disclosed by the prior art device in FIG. 1 because of link 14.

Figure 4:
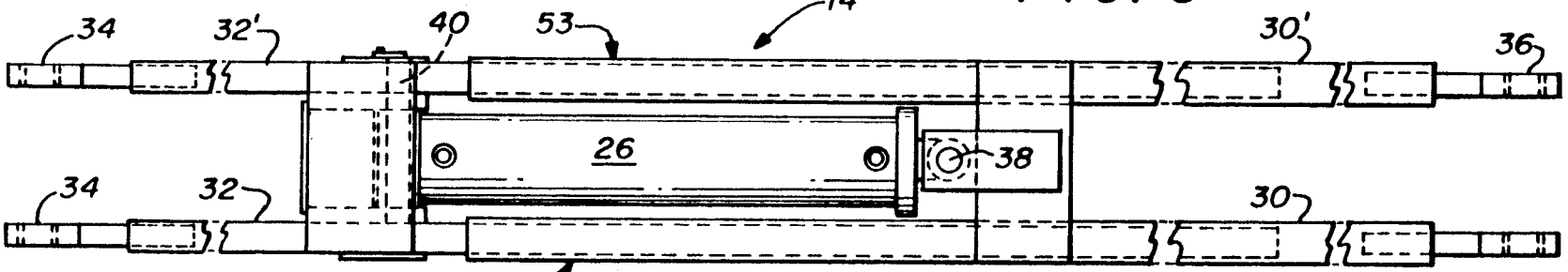
FIG. 4 is a top or plan view of the variable length link means of the present device.
Figure 5:
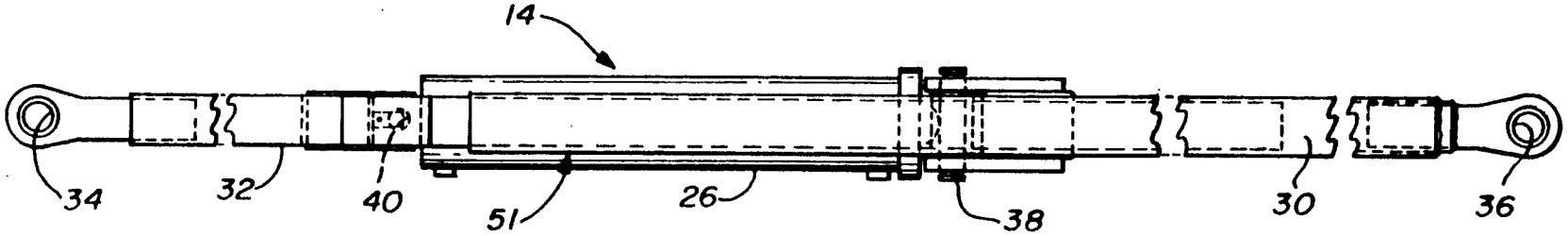
FIG. 5 is a side elevation of the novel variable length link means of the present invention.

In the present invention, link 14 has a selectively variable length and is formed in two sections slidable within each other as will be seen more clearly hereafter in relation to FIGS. 4 and 5. A hydraulic piston 26 couples the outer end of links 14 which are coupled to the knee joint 18 with the lower end of links 14 which are coupled to the turntable T. As the hydraulic cylinder 26 is actuated, the length of the links 14 changes, thus pivoting the upper boom 20 about pivot point 28 and causing the upper boom 20 and its extension 22 to be moved upwardly or downwardly as indicated in FIG. 2. As shown in FIG. 2, the existing unit can be pivoted upwardly a distance 50 feet above ground and downwardly until the nozzle assembly 24 is at ground level.

Figure 3:
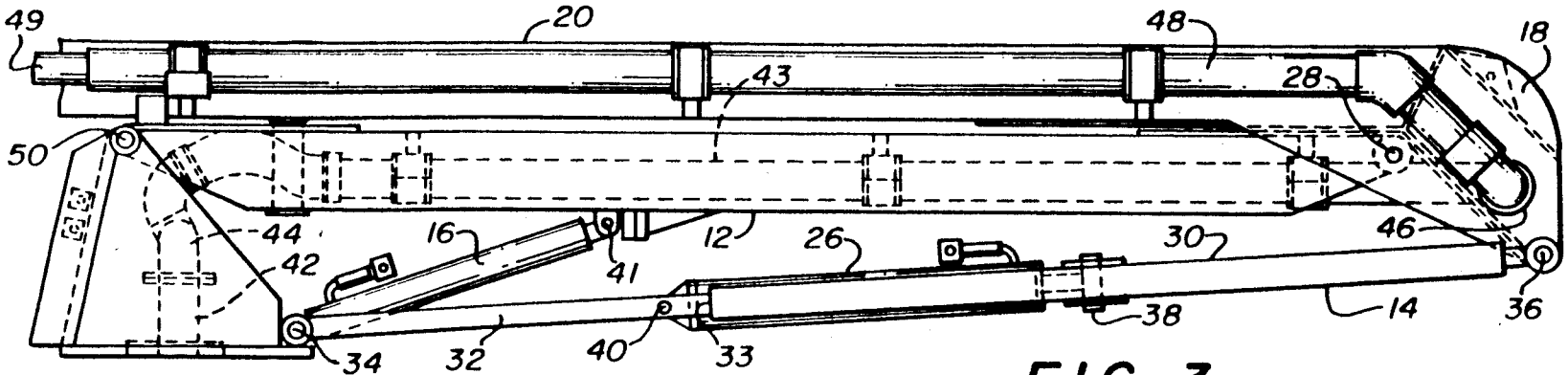
FIG. 3 is a partial side elevation of the upper and lower booms pivotally coupled together and the variable length link that is coupled between the inner end of the outer boom and the rotatable support on the vehicle.

As can be seen FIG. 3, the turntable T is rotatably mounted to the vehicle as described earlier. The link 14 has an outer end 30 and an inner end 32. The inner end 32 is pivotally attached to the rotatable turntable T at pivot point 34 while the outer and 30 of link 14 is attached to the knee joint 18 at pivot point 36. The hydraulic cylinder 26 is coupled at one end to the outer end 30 of the link 14 at point 38 while the other end of the hydraulic cylinder 26 is coupled to the inner portion 32 of link 14 at point 40. The inner portion 32 of link 14 is telescopically inserted on the inside of the outer portion 30 of link 14 as illustrated by joint 33. The hydraulic cylinder 16 is pivotally coupled at its inner end to the pivot point 34 on turntable T while its outer arm or rod is attached at point 41 to the lower boom 12. Upper boom 20 is pivotally attached at point 28 to lower boom 12. A water supply pipe 42 includes a swivel joint and receives water at the center point of the rotatable turntable T and passes it through a flexible hose 44 or any other desired connection to the outside of boom 12. It travels in a pipe 43 on the other side of boom 12 as shown in phantom lines to and is connected with the rotatable joint 46 in the knee joint 18. Joint 46 couples pipe 43 to the fluid pipe 48 which continues longitudinally on the outside of upper boom 20 to carry fluid such as water to the nozzle assembly 24 on the outer end of boom 20. A pipe 49 is slidable within pipe 48 and is connected to extensible boom portion 22 for movement therewith. Thus, as the boom portion 22 moves inwardly and outwardly with respect to boom 20, pipe 49 moves inwardly and outwardly with respect to pipe 48. Thus, as can be seen in FIG. 3, when hydraulic cylinder 16 is actuated, lower boom 12 begins to pivot upwardly about pivot point 50 where its inner end is attached to turntable T. If link 14 does not change its length, movement of the lower boom will cause the upper boom 20 to pivot above pivot point 28, thus moving upper boom 20 away from lower boom 12 as illustrated in the prior art by FIG. 1. However, by varying the length of link 14 with piston 26, upper boom 20 can be pivoted about the point 28 with respect to lower boom 12 thus enabling the boom 20 to assume any of the positions illustrated in FIG. 2.

When the upper and lower booms 12 and 20 are in the bedded position illustrated in FIG. 2, they are positioned directly over the cab roof of the vehicle. The upper boom 20 can be extended approximately 16 feet in front of the cab while in the bedded position. This allows the operator to push any impending or approaching fire back away from the vehicle thus adding to the safety of the operating personnel. When the need arises to elevate the nozzle, the operator simply moves a single joystick hydraulic control in the vehicle cab in the proper direction to elevate the upper boom to a height of 50 feet or more with the existing unit. The nozzle device 24 is compact and versatile and can be positioned inside the door of an aircraft to deluge the interior if necessary. The tilt down feature of the boom allows the nozzle assembly 24 to be lowered to ground level. This feature will position the nozzle device in various positions below the horizontal plane.

As illustrated in FIG. 4, the variable length link assembly 14 includes a hydraulic cylinder 26 installed between the two telescopic pivot links 52 and 54. The link 52 includes an outer portion 30 and a telescoping inner portion 32. In like manner, link 54 includes an outer portion 30' and a telescoping inner portion 32'. The assembly 14 provides the capability to tilt the boom at an angle up to 40° below horizontal. The telescoping pivot links 52 and 54 are constructed of steel alloy testing at 46,000 psi or equal suitable material and is equipped with a bushing. The combination of articulation and tilt down allows the nozzle to be placed at ground level approximately 15 to 20 feet in front of the vehicle.

Figure 9:
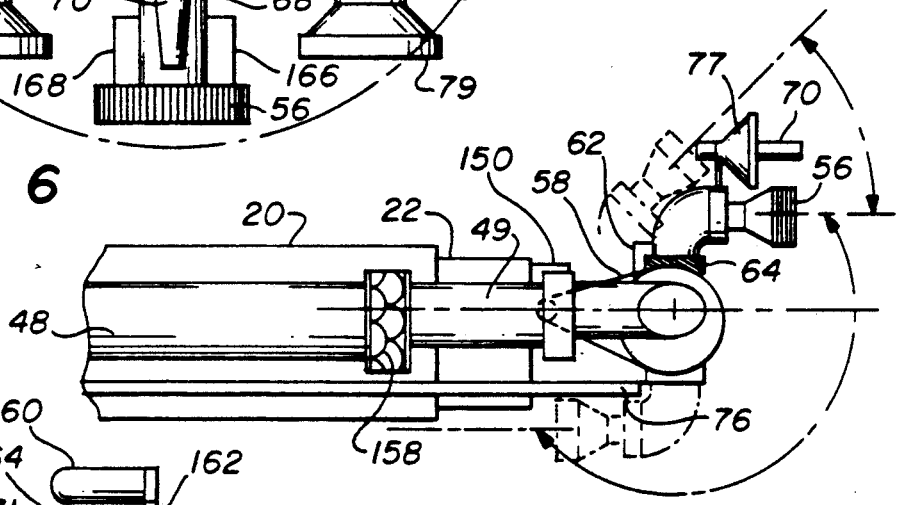
FIG. 9 is another side elevation of the novel nozzle assembly illustrating movement thereof in the vertical plane.

The upper boom 20 consists of a rectangular steel alloy tube outer section with an aluminum alloy telescoping inner section (or other materials suitable for the construction). The upper boom 20 is adequately reinforced to sustain all anticipated loads and nozzle reaction forces at full flow in all sweep directions. The extension and retraction of the upper boom is accomplished by a hydraulic cylinder providing a fully extended stroke of approximately 16 feet. The telescoping section is supported by phenolic pads for smooth, wear-free operation. Hydraulic hose and electrical lines are carried within a flexible tube support. All hydraulic hoses and electrical cables are contained inside the upper boom assembly 20 for maximum protection. The waterway piping system 48 shall be capable of flowing up to 1,000 gallons per minute with minimum friction loss. The waterway begins with a nominal 4-inch ID system containing a flexible connection at the base and extending along the lower boom section as light weight rigid tubing. The 4 inch waterway passes through the articulating section with the swivel assembly 46 and extends along the outside of the upper boom section 20. A 3¼" nominal ID telescoping waterway is provided on the upper boom assembly inside the 4-inch piping consisting of rigid tubing. Telescoping sections are sealed by special polypropylene glands 158 (FIG. 9). The waterway terminates with a 3-inch fitting for the nozzle sweep assembly 24.

Figure 6:
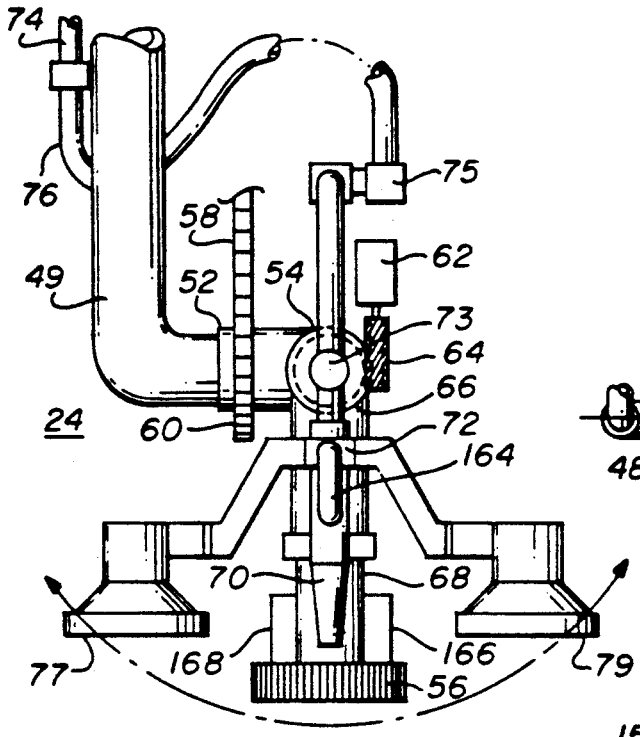
FIG. 6 is a top view of the novel nozzle used in the present invention.
Figure 7:
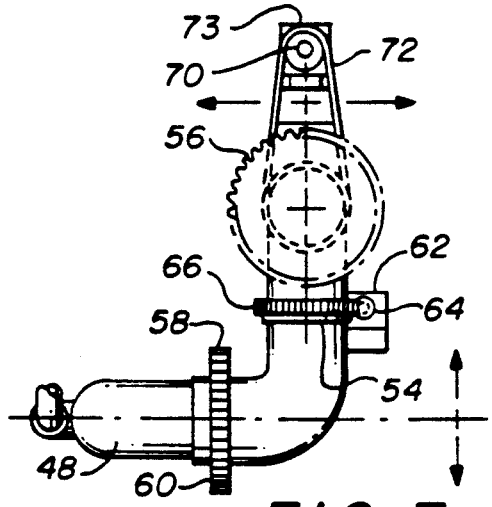
FIG. 7 is a front view of the nozzle illustrated in FIG. 6.
Figure 8:
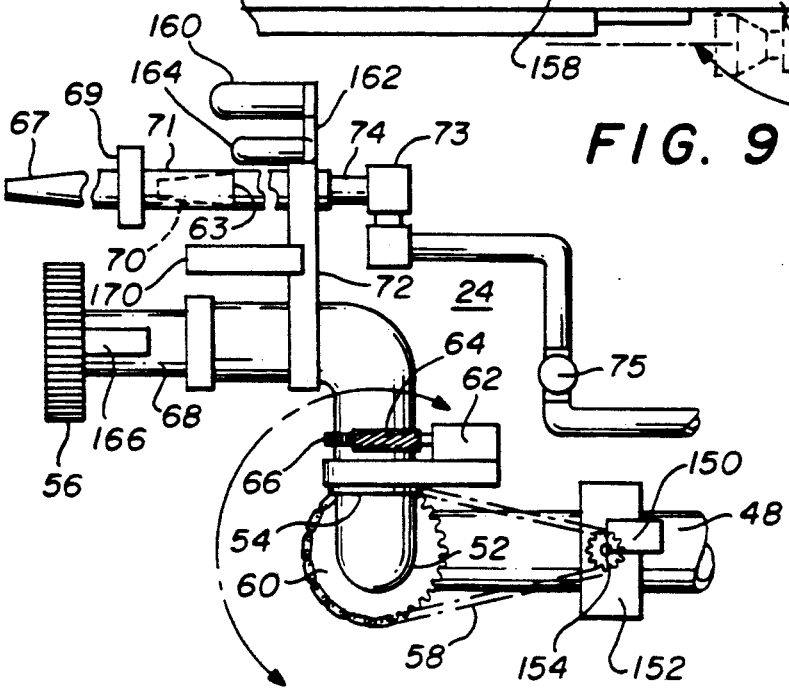
FIG. 8 is a side elevation of the novel nozzle illustrated generally in FIGS. 6 and 7.

The nozzle sweep assembly 24 consists of a 3 inch ID double swivel unit allowing the nozzle to sweep in both horizontal and vertical planes. Thus, as can be seen in FIGS. 6, 7 and 8, the waterway 48 turns at a first right angle and couples into a first swivel 52 and then turns a second right angle into a second swivel 54. The first swivel 52 has a sprocket 60 driven by a chain 58 which moves the nozzle 56 in a vertical plane with respect to the boom as can be seen best in FIG. 8. The drive system can cause the nozzle 56 to move upwardly above horizontal 45° and downwardly below horizontal 180° for a total movement of 225°. As can be seen in FIGS. 6, 8 and 9, a motor 62 drives a worm gear 64 that couples to gear 66 at the second swivel joint 54. Thus motor 62 can swivel the nozzle 56 90° in each direction from the axis of the boom for a total of 180°. The roller chain 58 rides on and is driven by a sprocket gear 154 which, in turn, is connected to an electric drive motor 150 through a gear box 152. Horizontal and vertical travel motions can be adjusted by placement of stops in the drive system that actuate a slip clutch in the drive motor.

If desired, a halon or other specific agent nozzle 70 may be attached by means 72 to the nozzle assembly 24 along side the water/foam nozzle 56. Nozzle 70 receives the agent from a supply tank 17 shown on the vehicle in FIG. 2. Piping consists of a stainless steel or equal telescoping tube 74. Stainless steel swivel fittings 73 and 75 similar to those described for the nozzle assembly 24 are installed to allow the auxiliary nozzle to rotate and elevate in conjunction with the movements of nozzle assembly 24. Flexible tube 76 couples telescopic tube 74 to swivel fitting 75.

If desired, instead of using the short halon nozzle 70, an elongated piercing nozzle 71 may be used. This nozzle has a piercing head 65, a sprayer unit 67 and a stop collar 69. The stop collar 69 may have an outside diameter of approximately 5 inches, while the nozzle 71 itself may have an outside diameter of 2 inches. These diameters are for example only and may vary. The stop collar 69 is rigidly attached to the nozzle 71 such as, for instance, by welding or being integrally formed therewith. The stop collar 69 sits just in front of nozzle 56. The purpose of the stop collar 69 is to protect the nozzle assembly when the piercing nozzle 71 is used to penetrate a structure wall or container. It is able to provide a stop which protects the nozzle 56 and its related elements by limiting the distance the piercing nozzle 71 can penetrate the structure wall. The nozzle 71 may use any special agents, such as halon or dry chemicals in conjunction with the piercing point 65 and the spray unit 67. Thus, the operator can approach an object or structure on fire, such as an airplane, and extend the boom with the piercing nozzle extending in the front thereof and penetrate the fuselage wall to spray the fire retardant on the interior of the plane. The length of the nozzle 61 from the attachment point at 63 where it may be screwed to the tube 74 is approximately 24 inches. It may also extend in front of the stop collar 69 approximately 18 inches.

It may, of course, be impossible to tell where in a structure that hot spots are occurring simply by viewing the structure. By placing a heat sensor 164 on the nozzle assembly as illustrated in FIG. 8, the nozzle assembly on the end of the boom can be used to scan the fuselage or other structure to find the hot spots. When the heat sensor indicates the greatest amount of heat, the operator can then use the piercing nozzle 71 to penetrate the structure at that point to release the fire retardant chemicals. Heat sensor 164 may be of any well-known type in the art.

In addition, there are occasions when the structure cannot be seen visually because of clouds of smoke surrounding it. In that case, a proximity sensor 170 mounted on attachment means 72 can be utilized to give the operator an indication of the distance from the nozzle assembly to the structure. Thus, the operator, by using the heat sensor 164, can tell where the hot spot is without being able to see the structure. He can then extend the nozzle end of the boom into the smoke and utilize the proximity sensor 170 to determine the distance of the nozzle from the structure even though he cannot see the structure. The proximity detector may be of the type entitled "Ultra-Sonic Tattletale Safety System", a trademark for a system for use on vehicles. The heat sensor 164 may be of any type well known in the art and in particular such as the type sold under the trademark "Life Sight", which works on the principle of radiated heat. It "sees" heat and creates a small television heat image that allows the user to see through smoke, utilizing the fact that thermal energy is not blocked by smoke particles as is ordinary light. With this device, any object that is 0.5° F. different from the surrounding area can be detected.

In addition, there are times when the operator has forward vision blocked by an object of some type. For instance, it may be advisable to "see" on the other side of the fuselage of an airplane. With the present advice, as illustrated in FIG. 8, a video camera transmitter 160 is mounted on the mounting structure 72 so that the operator can raise the boom and position it in the vertical and horizontal planes to scan the area of concern. By raising the boom, and maneuvering the nozzle assembly, the camera can be caused to view areas and transmit pictures to a receiver in the vehicle so that the operator can "see" the entire area, thus aiding in the ability to control a fire. Again, the video camera 160 may be of any type well-known in the art which is controlled electrically in any well-known manner from the cab of the vehicle.

Further, present nozzles used on the aerial assemblies do not have the capability of changing the flow quantity except by changing pressure. The only way to change it in the prior art is to simply change the volume of water flowing by restricting water flow through a valve on the side of the supply vehicle. In the present invention, nozzle 56 is of a type well-known in the art, but not used on remote aerial booms, that control flow quantity by restricting the orifice and control the flow pattern thereby varying the fluid flow direction through the orifice. Such a nozzle is sold by Feecon Corporation. In the present device, as seen in FIG. 6, electric driven motors 166 and 168 are mounted on each side of the nozzle pipe 68 and are electrically controlled from the cab. Electric motor 166 changes the orifice restriction of the Feecon Corporation nozzle to control the flow quantity of fluid at the output of nozzle 56. Electric motor 168, also operated from the cab in a well-known manner, controls the flow pattern by varying the direction of fluid flow through the nozzle. Thus it can be a fine spray pattern or a concentrated stream. Thus, the quantity of fluid flow can be controlled without changing the pressure.

Further, if desired, two combination flood/spot lights 77 and 79 with one million peak candle power each may be attached to the nozzle assembly 24. In that case each light has quartz halogen bulbs and operates on a 12 volt system. The lights may be remotely switched from spot to flood modes. The flood mode provides full 150° illumination. The complete system is weather proofed and the lights rotate and elevate with the nozzle movement to provide illumination of the water/foam stream or act as an independent remote controlled light tower. Provision has also been made to accommodate other electrically or pneumatically operated devices that may be located at or near the end of the boom.

Thus, there has been disclosed a novel aerial boom system which allows a vehicle to be operated for a full range of responsibilities. The system is designed to be placed in operation during the roll in approach to a fire such as an aircraft incident and to begin discharging agent on the fire without restricting the mobility of the vehicle. The engine driven or P.T.O. driven hydraulic system allows the nozzle to be operated without disruption of the vehicle normal operation. When the vehicle is responding to a normal incident where there is no need to elevate, the all electric control nozzle can be utilized much like a standard roof mounted turret. Joystick controls simplify the operation. Joysticks incorporate potentiometers to allow proportional adjustment of hydraulic cylinders as is well known in the art. Capability is provided for preprogrammed boom/nozzle movements.

When the assembly is in the bedded position, it is positioned directly over the cab roof. The boom can be extended approximately 16 feet in front of the cab while in the bedded position. This allows the driver/operator to push any impending or approaching fire back away from the vehicle, thus adding to the safety of the operating personnel. When the need arises to elevate the nozzle, the operator simply moves a single joystick in the proper direction. Hydraulic pressure then elevates the boom to a height of 50 feet or more on existing models. The nozzle device is compact and versatile and can be positioned inside the doorway of an aircraft to deluge the interior if necessary. The additional halon or other auxiliary agent system gives greater depth to the overall performance. The halon auxiliary agent nozzle is attached to the water/foam nozzle and is positioned by utilizing the joystick control that moves the water/-foam nozzle.

The nozzle has the capability of rotating 90° either side of the center line of the boom. This allows the nozzle to be rotated 180° on the horizontal plane. It can also be rotated in the vertical plane plus 45° above horizontal and minus 180° below horizontal in the vertical plane.

The two one million candle power spot/flood lights enhance nighttime capabilities. The power for the light is supplied by a switch on the instrument panel.

Auxiliary electric or pneumatic functions can be added to the end of the boom for other fire fighting or rescue operations.

Joystick controls are capable of proportional hydraulic cylinder movement and can be combined with other electronic components for preprogrammed nozzle/-boom movements.

The tilt down feature of the nozzle allows the nozzle to be lowered to ground level. This feature positions the nozzle device in various locations below the horizontal plane to address a variety of tasks.

The piercing nozzle allows the operator of the boom to extend the piercing nozzle through the wall of a structure to inject the fire-fighting chemicals directly inside the structure containing the fire. The use of the stop collar prevents the nozzle assembly from being damaged by inserting the piercing nozzle too great a distance into the structure. Through the use of a heat sensor, the operator can scan the structure with the boom movements and the nozzle movements to find the hot spots. In addition, the heat sensor can locate the hot spots even though the structure is surrounded by heavy smoke. In addition, the proximity sensor can allow the operator, after locating the hot spots, to insert the piercing nozzle through the wall at that point, even though the wall cannot be seen because the proximity sensor indicates to the user the distance of the end of the boom from the structure. Also, the remote control of the nozzle by two electric motors allows the user to vary not only the volume of water being used, but also the flow pattern.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. In an aerial lift for a vehicle of the type having an operator's cab at the front thereof, an upper boom pivotally connected at a point adjacent its inner end to the outer end of a lower boom for pivotal movement with respect to each other, a support attached to the vehicle for rotation about an upright axis, the lower boom being pivotally connected at its inner end to the support and extending generally horizontally in a storage position, a power source coupled between the support and the lower boom for moving the lower boom upwardly and downwardly about is pivotal connection to the support, the improvement comprising:

variable length link means having an inner end pivotally coupled to said support and an outer end pivotally connected to the inner end of the upper boom beyond its pivot connection to the lower boom such that upward movement of the outer end of the lower boom causes the outer end of the upper boom to raise generally vertically as the lower boom is raised;

power means coupled between the inner and outer ends of the variable length link means for selectively changing the length of the link to move the upper boom about is pivot point with the lower boom in any position of the lower boom;

an extensible section forming part of the upper boom and controllably movable to any selected position between a fully retracted and fully extended position under both full and no fluid flow conditions such that the outer end of the extensible boom can be positioned from a point at least a grade level to full elevation above the vehicle;

a fluid discharge nozzle assembly mounted on the outer end of the extensible boom;

a single fluid conduit for supplying fluid to the nozzle;

a first rotatable fluid connection coupled to the discharge nozzle assembly and to the single fluid supply conduit to allow the nozzle to be positioned only in a vertical plane from substantially +45° to −180°; and a second rotatable fluid connection coupling the discharge nozzle assembly to the first rotatable fluid connection to allow the nozzle to be positioned ±90° only in a plane perpendicular to the vertical plane so as to enable fluid to be directed in any selected forward direction from any position of the discharge nozzle assembly from at least grade level to full elevation.

2. An aerial lift as in claim 1 wherein said link means comprises a pair of adjustable length links disposed on opposite sides of the power means to stabilize said upper boom laterally.

3. An aerial lift as in claim 2 further including:

force means for moving the extensible boom relative to said upper boom to and from any selected position; and the outer end of the extensible boom rising generally vertically as the lower boom is raised when the selected position of the extensible boom remains unchanged during lifting of the lower boom.

4. An aerial lift as in claim 3 wherein the means for selectively changing the length of the link means comprises:

a hydraulic cylinder and piston rod; and the hydraulic cylinder being connected between and to one end of the links and the piston rod being connected between and to the other end of the links.

5. An aerial lift as in claim 4 wherein the support comprises:

a turntable rotatable about a vertical axis through 360°; and the single fluid conduit for supplying fluid to the nozzle includes a swivel joint at approximately the center of the turntable.

6. An aerial lift as defined in claim 5 wherein:
the extensible boom is slidably mounted within the upper boom;
the means for supplying fluid to the nozzle includes a first pipe attached externally and longitudinally to the upper boom; and
a second pipe slidable within the first pipe and connected externally to the extensible boom for movement therewith.

7. An aerial lift as in claim 6 wherein the fluid supply means includes:
a third pipe mounted on the lower boom;
a swivel fluid joint in said inner end of the upper boom connecting the outer end of the third pipe with the inner end of the first pipe;
a supply pipe including the swivel joint mounted centrally of the turntable; and
a flexible connection between the supply pipe and the inner end of the third pipe.

8. An aerial lift as in claim 7 further comprising:
a first hydraulic cylinder and piston rod adapted to move the lower boom upwardly and downwardly;
one end of the hydraulic cylinder and piston rod being pivotally connected between the pair of links on a pivot on the support for the links; and
the other end of the hydraulic cylinder and piston rod is pivotally connected to the underside of the lower boom.

9. An aerial lift as in claim 8 further including:
first motor means for rotating the nozzle about the first rotatable fluid connection to position the nozzle in the vertical plane without affecting the horizontal position of the nozzle assembly; and
second motor means for rotating the nozzle about the second rotatable fluid connection to position the nozzle in a plane perpendicular to the vertical plane without affecting the vertical position of the nozzle assembly such that control means in the vehicle may be coupled to the first and second motor means for remotely operating the first and second motor means to position the nozzle.

10. An aerial lift as in claim 9 wherein the second motor means and the second rotatable fluid connection are mounted on the discharge nozzle assembly that is rotatable in the vertical plane such that movement of the nozzle assembly in the horizontal plane does not affect the position of the nozzle assembly in the vertical plane.

11. An aerial lift as in claim 10 further including an auxiliary agent nozzle mounted on and spaced adjacent from the discharge nozzle for rotation in said vertical plane and the perpendicular plane following the movement of the discharge nozzle.

12. An aerial lift as in claim 11 further including:
a first rotatable fluid connection pivotally coupled to the agent nozzle for enabling the auxiliary agent nozzle to rotate only in the perpendicular plane when the discharge nozzle is rotated in the perpendicular plane; and
a second rotatable fluid connection pivotally coupled to the first rotatable fluid connection to enable the auxiliary nozzle to move only in the vertical plane when the discharge nozzle is moved in the vertical plane.

13. An aerial lift as in claim 12 further including:
a source of said auxiliary agent on the vehicle;
a third rotatable fluid connection in the pivotal support coupled to the source of the auxiliary agent;
an additional telescopic fluid tube attached to and along the upper boom to the end thereof for changing length with extension of the upper boom;
a first flexible tube having one end coupled to the inner end of the telescopic fluid tube and the other end coupled to the third rotatable fluid connection in the pivotal support; and
the other end of the telescopic tube being coupled to the second rotatable fluid connection to provide the auxiliary agent to the auxiliary nozzle.

14. Apparatus for positioning a nozzle on the outer end of an upper boom that faces forward on a fire fighting vehicle and is pivotally coupled adjacent its inner end to the outer end of a lower boom comprising:
a vehicle operator cab on the forward part of the vehicle from which the vehicle can be driven in the forward direction toward an objective such as a fire;
first power means for selectively and pivotally raising and lowering the lower boom in a vertical plane from and above a horizontal plane;
second power means for extending the upper boom between a fully retracted position to a fully extended position under both no fluid flow and full fluid flow conditions; and
third power means for independently articulating the upper boom about its inner end pivot with respect to the lower boom such that the nozzle on the outer end of the upper boom is selectively movable in front of the cab from a point at least at ground level to full elevation above the vehicle in any position of rotation about the vertical axis with the outer end of the upper boom being in view of the vehicle operator.

15. An aerial lift as in claim 14 further including:
a fluid discharge nozzle assembly mounted on the outer edge of the extensible boom;
means for supplying fluid to the nozzle; and
motor means mounted on the nozzle assembly for remotely controlling the fluid flow quantity passing through the nozzle and for controlling the flow pattern.

16. An aerial lift as in claim 14 further comprising:
a hollow piercing nozzle mounted on the outer end of the upper boom and extending forward of the outer end of the upper boom;
at lest one orifice in the piercing nozzle; and
a conduit for coupling a fire extinguishing fluid to the nozzle so as to inject the fluid into the interior of the structure that has been penetrated by the piercing nozzle.

17. An aerial lift as in claim 16 further including:
a heat sensor mounted on said nozzle assembly adjacent to said piercing nozzle, such that hot spots in a structure can be detected by the heat sensor to enable the fire retardants to be applied to those areas and, as necessary, the piercing nozzle used to penetrate the structure at those hot spots to assist in controlling the fire.

18. An aerial lift as in claim 16 further including:
a proximity sensor mounted on the nozzle assembly for enabling detection of the distance of the boom from an object obscured by smoke particles, such that the boom nozzle assembly can be moved into the smoke area while enabling the operator to detect its distance from the structure.

19. An apparatus as in claim 16 further including a video camera mounted on the boom assembly such that the operator can raise and lower the boom assembly and control the nozzle assembly in elevation and azimuth to cause the camera to view an area under consideration.

20. Apparatus for positioning a fluid nozzle assembly on the outer end of an upper boom that is pivotally coupled adjacent its inner end to the outer end of a lower boom on a vehicle comprising:

first power means for selectively and pivotally raising and lowering the lower boom in a plane from and above a horizontal plane;

second power means for independently articulating the upper boom about its pivot with respect to the lower boom such that the upper boom is selectively movable from a point at least at ground level to full elevation;

an extensible boom on the upper boom for moving the nozzle outwardly from the upper boom under both full and no fluid flow conditions;

motor means for positioning the fluid nozzle assembly in both vertical and horizontal planes; and a fluid carrying piercing nozzle mounted on the nozzle assembly adjacent to the fluid nozzle assembly and extending beyond the fluid nozzle assembly such that the piercing nozzle can be used to penetrate the wall of a structure to inject fluid within the structure by articulating the upper and lower booms, extending the upper boom as necessary and positioning the fluid nozzle assembly in the proper direction.

21. Apparatus as in claim 20 further comprising a stop collar mounted on the piercing nozzle to allow penetration of the piercing nozzle into a structure a predetermined distance.

22. Apparatus as in claim 20 further including a heat sensor mounted on the fluid nozzle assembly adjacent to the piercing nozzle so as to enable detection of hot spots in a structure and enable fire retardant chemicals to be applied thereto by the fluid nozzle assembly and the piercing nozzle.

23. Apparatus as in claim 20 further including a proximity sensor mounted on the fluid nozzle assembly adjacent to the piercing nozzle to enable a determination of the distance of the piercing nozzle from a structure under conditions where the piercing nozzle is not visible because of smoke and contaminants.

24. An aerial boom for a vehicle comprising:

an upper boom and a lower boom, the upper boom being pivotally coupled adjacent its inner end to the outer end of the lower boom, the upper boom being extensible between a fully retracted and a fully extended position under both no fluid flow and full fluid flow conditions;

means for rotatably and pivotally coupling the inner end of the lower boom to the vehicle for 360° rotation of the upper and lower booms about a vertical axis;

means coupled between the lower boom and the vehicle for raising and lowering the lower boom about its vehicle pivot point; and a link having a selectively variable length coupled between the inner end of the upper boom and the vehicle for selectively pivoting the upper boom with respect to the lower boom so as to enable the upper boom to be pivoted from a point below grade level to full elevation above the vehicle at any point in the 360° rotation of the booms.

25. A method of positioning a fluid nozzle on the outer end of an upper boom that faces forward on a vehicle and is pivotally coupled adjacent its inner end to the outer end of a lower boom comprising the steps of:

selectively and pivotally raising and lowering the lower boom in a vertical plane above a horizontal plane;

selectively extending the upper boom between a fully retracted position and a fully extended position under both no fluid flow and full fluid flow conditions; and independently articulating the upper boom about its inner end pivot with respect to the lower boom such that the nozzle on the outer end of the upper boom is selectively movable in front of the vehicle from at least ground level to full elevation above the vehicle.

* * * * *